US008951466B2

(12) United States Patent
Wakade et al.

(10) Patent No.: US 8,951,466 B2
(45) **Date of Patent: *Feb. 10, 2015**

(54) METHOD OF MAKING COMPONENT SHAPES HAVING NON-ROUND EXTERIOR SHAPES

(75) Inventors: Shekhar G. Wakade, Grand Blanc, MI (US); Frederick J. Rozario, Fenton, MI (US); Glenn E. Clever, Washington, MI (US); Joseph E. Robbins, Mayville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1542 days.

This patent is subject to a terminal disclaimer.

(21) Appl. No.: 12/359,391

(22) Filed: Jan. 26, 2009

(65) Prior Publication Data

US 2010/0189587 A1 Jul. 29, 2010

(51) Int. Cl.
*B22F 1/00* (2006.01)

(52) U.S. Cl.
USPC ..... 419/66; 123/90.6; 425/78

(58) Field of Classification Search
USPC ..... 419/66; 425/78
IPC ..... B22F 3/087,5/10
See application file for complete search history.

(56) References Cited

U.S. PATENT DOCUMENTS 5,405,574 A 4/1995 Chelluri et al.
5,611,139 A 3/1997 Chelluri et al.
5,611,230 A 3/1997 Chelluri et al.
5,689,797 A * 11/1997 Chelluri et al. ..... 419/38
7,455,509 B2 11/2008 Knoth et al.
7,574,995 B2 * 8/2009 Graham ..... 123/506

FOREIGN PATENT DOCUMENTS

CN 2425728 Y 4/2001
DE 3907886 A1 3/1989
JP 60-43405 A 3/1985
JP 60043405 A * 3/1985

OTHER PUBLICATIONS

German Office Action dated Feb. 7, 2013 for DE 10 2009 043 382.1 which pertains to U.S. Appl. No. 12/247,287, filed Oct. 8, 2008.

* cited by examiner

*Primary Examiner* — Weiping Zhu
(74) *Attorney, Agent, or Firm* — Dinsmore & Shohl LLP

(57) ABSTRACT

Cam lobe packs and methods of producing the same. The method uses a tool made up of an insert disposed within a sleeve such that both are responsive to a dynamic magnetic compaction (DMC) pressure source. The insert defines a substantially axisymmetric exterior surface and a cam lobe-shaped interior surface that can receive a compactable material such that upon DMC, the material is formed into the shape of the cam lobe. The sleeve is disposed about the insert and defines a substantially axisymmetric exterior surface such that an axisymmetric compaction imparted to the sleeve by the DMC pressure source forms the desired shaped cam lobe. The tool is configured such that individual tool members corresponding to one or more of the cam lobes can be axially aligned so that an aggregate interior surface is formed that defines an exterior surface profile of a camshaft being formed.

15 Claims, 7 Drawing Sheets

METHOD OF MAKING COMPONENT SHAPES HAVING NON-ROUND EXTERIOR SHAPES

BACKGROUND OF THE INVENTION

The present invention relates generally to the manufacture of automotive engine components possessing irregular exterior shapes using a powder metallurgy process, and more particularly to the manufacture of such components using a modified dynamic magnetic compaction (DMC) process with variably adjustable tooling.

Automotive engine camshaft lobes must endure significant and repeated mechanical loading under high-speed, high-temperature and tribologically-varying conditions. The use of conventional manufacturing processes, such as casting, forging or the like, tends to produce components which, while satisfactory from a load-bearing perspective, result in heavy, inefficient structures. Likewise, the use of such conventional manufacturing approaches is not conducive to tailoring a particular material's desirable properties to discreet locations on a camshaft lobe. Furthermore, the use of DMC, which is taught in U.S. Pat. Nos. 5,405,574, 5,611,139, 5,611,230 and 5,689,797 (all of which are hereby incorporated by reference), while a valuable way to compact both metallic and non-metallic powders to achieve high-density components, has not hitherto been extended to camshaft lobes, gears or other non-axisymmetric (i.e., non-cylindrical) or otherwise irregularly-shaped components.

Camshaft lobes are typically aligned such that they rotate about the common longitudinal axis of a shaft to which they are affixed, where the number of cam lobes varies depending on the configuration of the engine, including number of cylinders, valves per cylinder or the like. In fact, one notable attribute of a camshaft is the generally repeating nature of the various eccentricities and related protuberances along the length of the shaft. In recent years, cam lobes are also designed together in groups known as multi-lobe packs, in order to facilitate variable valve timing used for improved fuel efficiency, of which three-lobe packs are the most common. In these multi-lobe packs, rotational orientation of individual lobes may be staggered such that a protuberating portion of one lobe may be radially offset relative to that of its immediately axial neighboring lobe such that when the pack is coupled to a shaft and placed in an engine, the lobe orientation in the resulting camshaft ensures proper timing of engine valve opening and closing. Such offset configuration tends to exacerbate an already complicated arrangement of tooling used to make the lobe pack, where materials may additionally need to be strategically placed within the lobe to best take advantage of their particular structural properties in a lightweight, cost-effective way. It would be advantageous to develop ways to extend the efficient manufacturing attributes of DMC to the non-axisymmetric shapes of multi-component packs, such as camshaft lobe packs and related repeating-configuration components, to improve the quality and reduce the cost of producing the manufactured part.

BRIEF SUMMARY OF THE INVENTION

These advantages can be achieved by the present invention, wherein improved engine components and methods of making such components are disclosed. According to a first aspect of the invention, a method of fabricating lobe packs that can be used on a camshaft is disclosed using DMC in conjunction with variably-oriented stackable tooling. In this way, the method includes both the irregular shape of the exterior profile of the lobes, as well as the radial orientation of two or more successive and generally similar components along the axis of rotation of a common shaft, can be made as part of a multi-component group or pack. The method includes fabricating one or more lobe packs for a camshaft using DMC. Numerous tooling dies (also called members) are arranged to cooperate with one another along their respective substantially axial dimensions, and each has an exterior and an interior, where the latter is shaped like an exterior shape of the lobe pack. By placing a powder material within the interior of the tooling dies and passing electric current through an electrically conductive coil that surrounds the dies, a magnetic pressure pulse is applied to the dies to achieve DMC of the powder material contained therein. In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

In one optional form, the powder material is a metal powder. In another form, the powder material may include a first powder material and a second powder material that has different wear properties than the first powder material. The second powder material may be placed in a location in the tooling dies such that upon DMC, the first and second powder materials can be compacted together to form a substantially unitary lobe structure. For example, the material exhibiting more robust or otherwise desirable load or wear features can be used to form at least a portion of the more highly-loaded part of the lobe's exterior surface (such as the portion corresponding to the lobe eccentricity. As with the previous aspect, one significant advantage over the prior art DMC process is that the non-axisymmetric interior die surfaces are amenable to irregular component shapes such as the eccentric portion of the lobe. The numerous tooling dies may include at least a first die defining a first interior profile corresponding to a first lobe pack and a second die defining a second interior profile corresponding to a second lobe pack. Furthermore, at least one of the first lobe pack and the second lobe pack comprises a two-lobe pack or a three-lobe pack. In a particular form, one or more of the lobe packs have an exterior shape made up of axially-spaced lobes with an axisymmetric journal defining a common shaft between them. The exterior and the interior of each of the tooling dies can be sized to form one of the lobes, while others are configured to form more than one lobe. In this latter configuration, the plurality of lobes within the pack can be radially aligned relative to one another in a manner dictated by the configuration of the camshaft formed by the lobe packs. Furthermore, the arranging of numerous tooling dies may include stacking these tooling dies, if necessary, by nesting the engaging ends of adjacent dies. In this way, the dies together define a singular tool that as a unitary whole mimics one-piece construction; within such construction, the die interior surface defines multiple lobes of at least one lobe pack.

In another option, instead of a powder, the second material may be in the form of a substantially rigid insert. Such insert may be made from a different material from the alloy used to make up the remainder of the lobe. In one form, the different material may be a hardenable steel alloy, ceramic material or other long-wearing, high load-bearing composition. Such an insert defines a profile such that can be placed over at least a portion of the first material such that the second material forms an outer surface of the eccentric part of the lobe. The second material can be placed in such a way that it makes up at least a majority of the non-axisymmetric exterior profile, or takes a majority of the loading when the load is at a maximum. The substantially rigid insert may be made to be either reusable or non-reusable. In the case of the latter, the insert may remain with the formed lobe upon completion of the compaction. In the case of the former, such as when being used to shape the outer profile of the lobe, the insert does not remain with the lobe after lobe fabrication, so that the insert may be reused.

According to another aspect of the invention, a method of fabricating an automotive camshaft using DMC is disclosed. The method includes providing tooling dies each with a substantially axisymmetric sleeve disposed about one or more inserts such that a substantially axisymmetric exterior surface of the insert (or inserts) is engagable with the substantially axisymmetric inner surface of the sleeve. The inserts also each include an interior surface configured to receive at least one compactable powder material therein. The tooling dies are shaped as multi-lobe packs, such as two-lobe packs, three-lobe packs or the like. The method also includes placing the compactable powder material within the die interior surface and compacting the material through a magnetic field set up by passage of an electric current through an electrically conductive coil that is wound about the substantially axisymmetric sleeves of the tooling dies. In this way, lobe packs are formed by the DMC process can be joined together to form an assembled camshaft.

Optionally, the interior surface defines axially aligned cam lobes spaced apart from one another by substantially axisymmetric journals. In another option, the powder material comprises a first powder material and a second powder material that has higher wear properties relative to the first powder material. Preferably, the first and second powder materials become affixed to one another to form a substantially unitary lobe structure and the second powder material occupies a portion thereof that is exposed to at least one of an increased sliding load and an increased rolling load relative to a portion of the lobe that is occupied by the first powder material. In another option, only the first material is a powder, while the second material is a substantially rigid material that has enhanced mechanical or related structural properties relative to the first.

According to yet another aspect of the invention, a tool for making a multi-lobed automotive camshaft pack is disclosed. The tool includes inserts that define a substantially axisymmetric exterior surface responsive to a DMC pressure source and an interior surface configured to receive a compactable material. The inserts can be made from multiple pieces with a substantially axisymmetric outer profile, while being separable along one or more split lines. The tool also includes a substantially axisymmetric sleeve disposed about the insert. Upon axial alignment and coupling together of the tools, an aggregate interior surface defining a camshaft exterior surface profile is formed.

Optionally, the tool further includes a first pathway configured to deliver a first powder material to a first part of a lobe in the lobe pack, and a second pathway configured to deliver a second powder material to a second part of the lobe. The first and the second powder material is delivered to the region of interest using variable powder feed rate and nozzle opening geometries such as round, oval or slotted shape. The first and second pathways are configured such that upon DMC, the materials fed therethrough become affixed to one another to form a substantially unitary lobe structure. The sleeves of the tools are shaped to allow axial stacking; in this way, longer sections of a camshaft may be formed. In one form, the axial ends of each of the sleeves may be flanged to define a step-like mounting ridge so that upon axial engagement of adjacent sleeves, a nesting connection is formed.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1C:
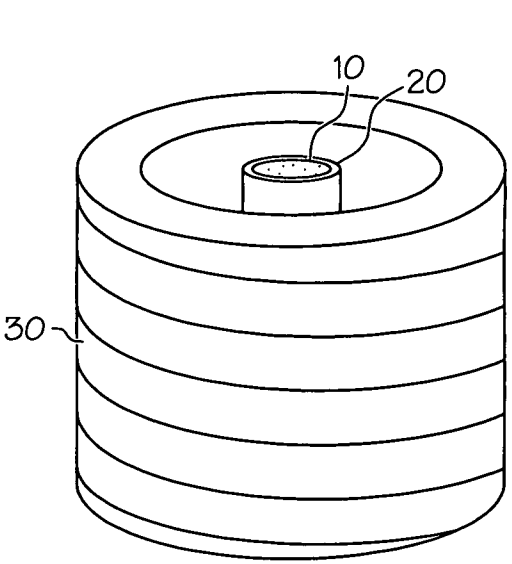
FIG. 1C (PRIOR ART)
FIGS. 1A through 1C shows the various steps and tooling used in the DMC process of the prior art for making a cylindrical-shaped powder component.
Figure 1B:
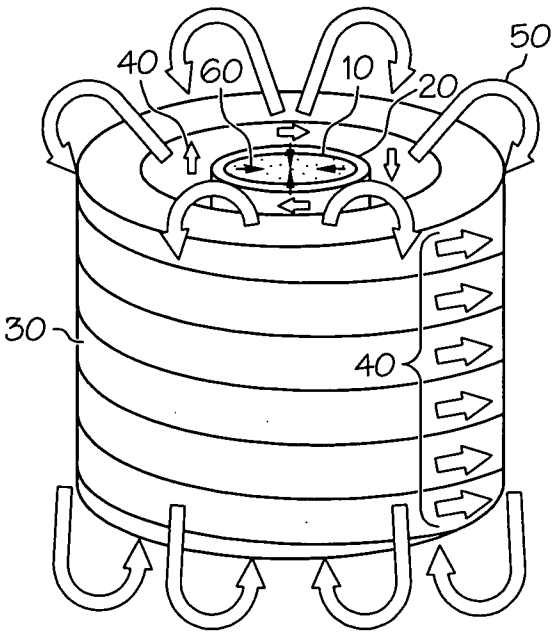
FIG. 1B (PRIOR ART)
Figure 1A:
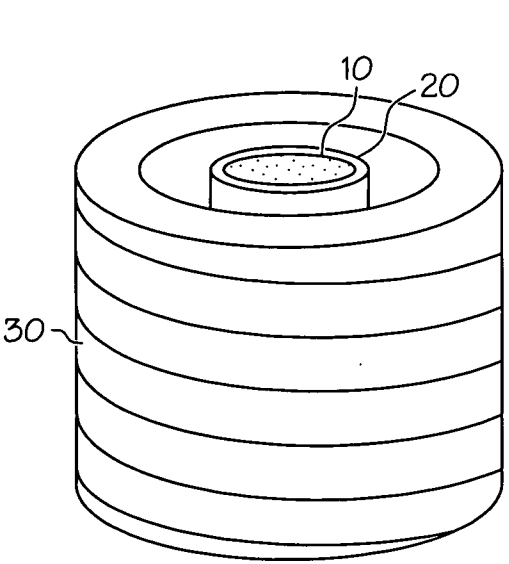
FIG. 1A (PRIOR ART)

Referring initially to FIGS. 1A through 1C, the DMC process according to the prior art is shown, where a generally axisymmetric (i.e., cylindrical-shaped) component is produced. FIG. 1A shows a powder material 10 placed within an electrically conductive cylindrical sleeve (also referred to as an armature or container) 20, where the powder material 10 substantially fills the sleeve 20. A coil 30 is connected to a direct current power supply (not shown) such that electric current can be passed through the coil 30. Referring with particularity to FIG. 1B, a large quantity of electrical current 40 is made to flow through the coil 30; this current induces a magnetic field 50 in a normal direction that in turn sets up magnetic pressure pulse 60 that is applied to the sleeve 20. This radially inward pressure acts to compress the sleeve 20, causing the powder material 10 to become compacted and densified into a full density part in a very brief amount of time (for example, less than one second) and at relatively low temperatures. In addition, this operation can (if necessary) be performed in a controlled environment to avoid contaminating the consolidated material. By way of example, the current flow through the coil 30 may be in the order of 100,000 amperes at a voltage of about 4,000 volts, although it will be appreciated that other values of current and voltage may be employed, depending on the characteristics of the sleeve 20 and the powder material 10 inside. Referring with particularity to FIG. 1C, once the DMC process is complete, the sleeve 20 and powder material 10 are shown compressed, occupying a smaller transverse dimension than the previous size of FIG. 1A.

Figure 2:
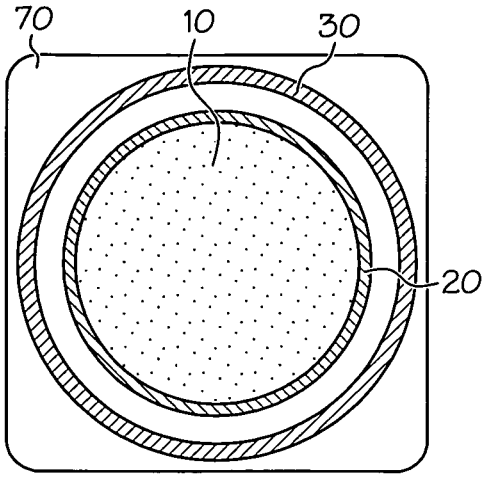
FIG. 2 (PRIOR ART)
FIG. 2 shows a top-down view of the cylindrical-shaped part placed in a tool of the conventional DMC process of the prior art.

Referring next to FIG. 2, a top-down view of the tooling making up a notional cylindrical DMC containment structure according to the prior art is shown, where the loosely held powder 10 is placed in sleeve 20. As discussed above in conjunction with FIGS. 1A through 1C, the sudden passage of a large amount of current through the coil 30 produces a magnetic field, which in turn induces a current in the sleeve 20. This induced current produces a second magnetic field which, by its magnitude and direction, repels the first magnetic field. This mutual repulsion causes sleeve 20 to be compressed, which in turn applies pressure on the powder 10, causing its compaction. Coil 30 is placed inside an external containment shell 70 to restrain the coil 30 against radially-outward expansion when repelled by the second magnetic field.

Figure 3:
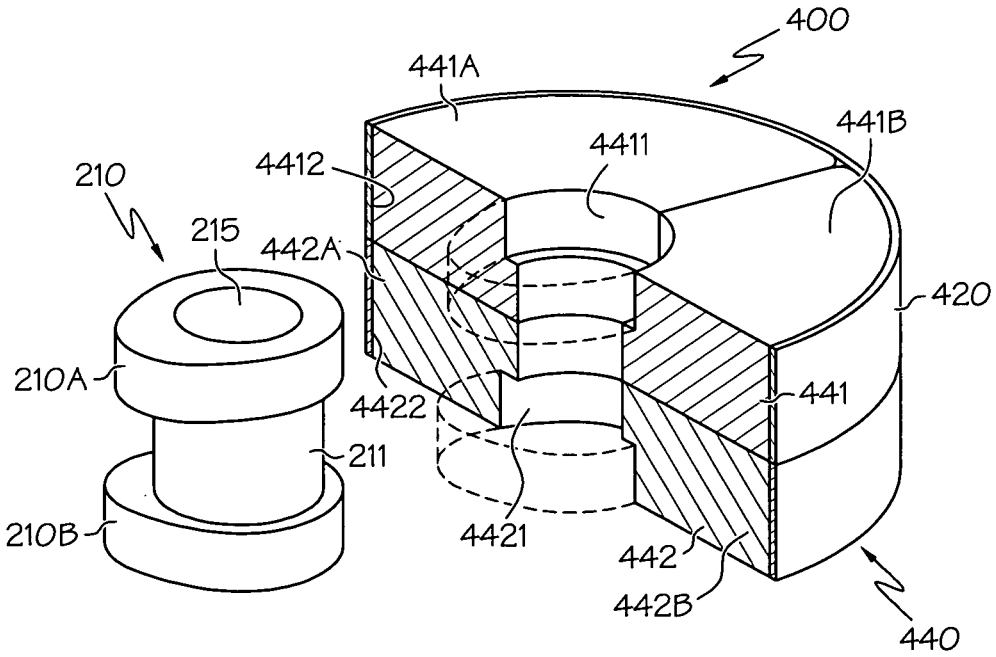
FIG. 3 shows a two-lobe pack that is manufactured with the stackable tooling modified DMC process of the present invention.
Figure 5:
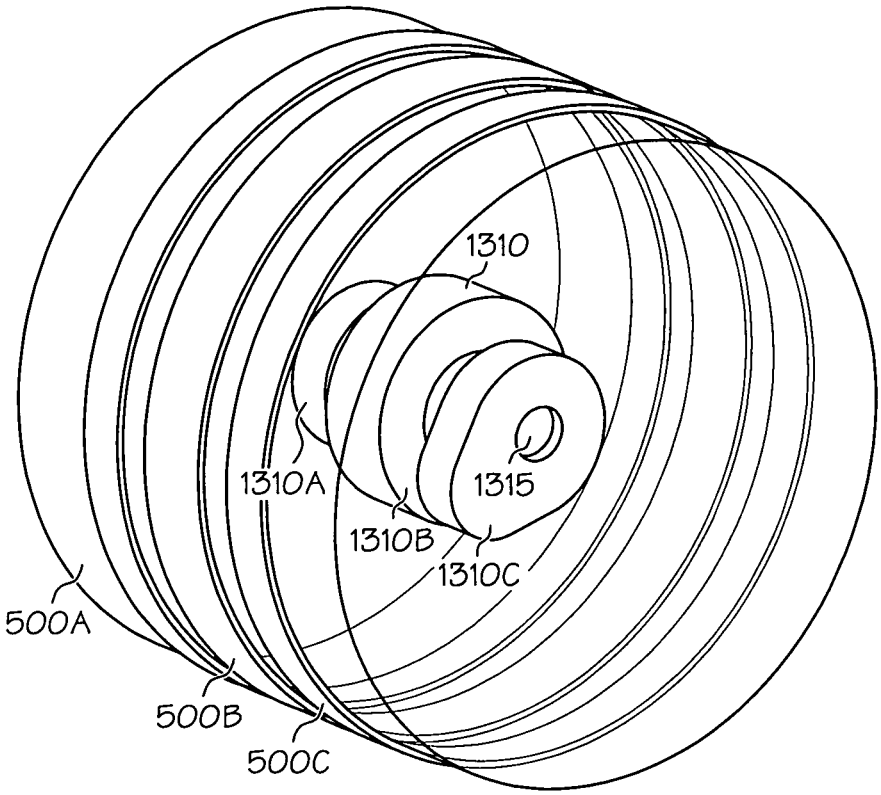
FIG. 5 shows three tooling members stackably aligned with one another to make another camshaft lobe pack configuration in which a cam journal is in the middle.
Figure 6:
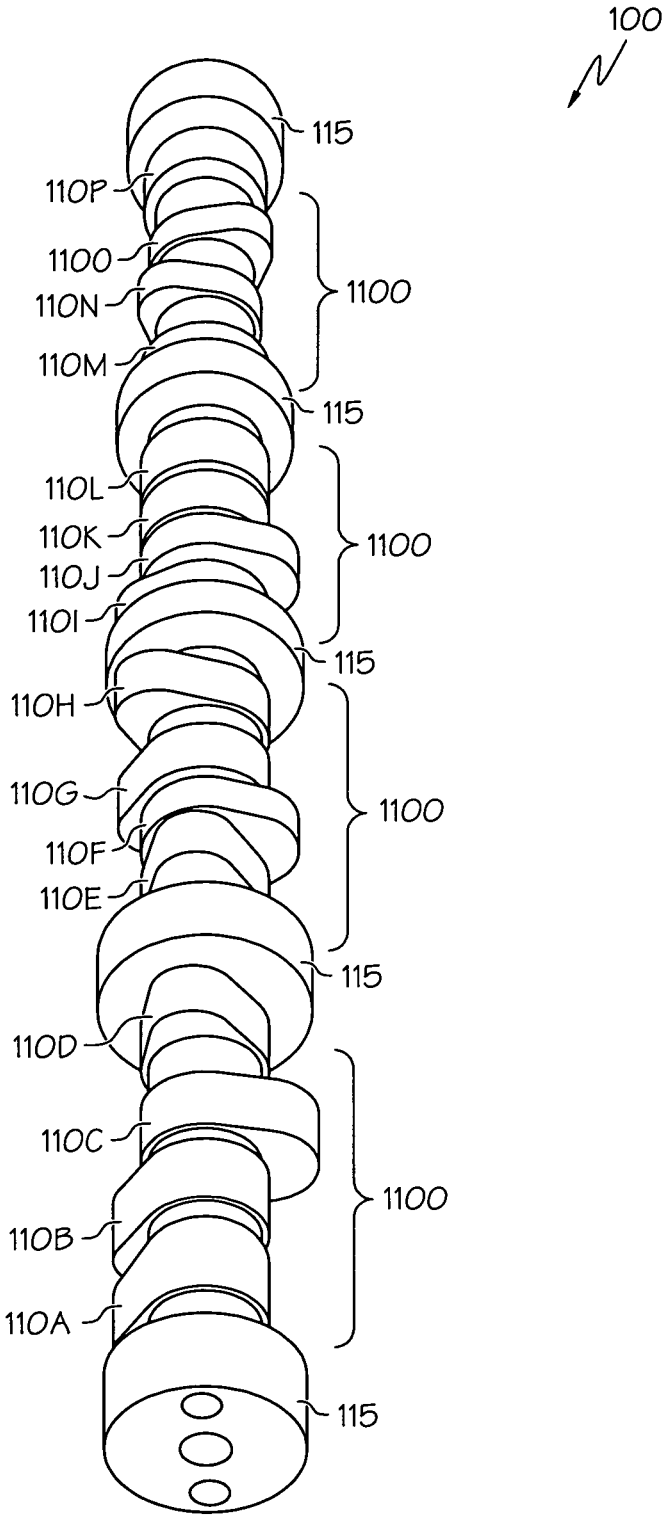
FIG. 6 shows a camshaft with lobe packs as produced by the stackable tooling modified DMC process of the present invention.
Figure 7:
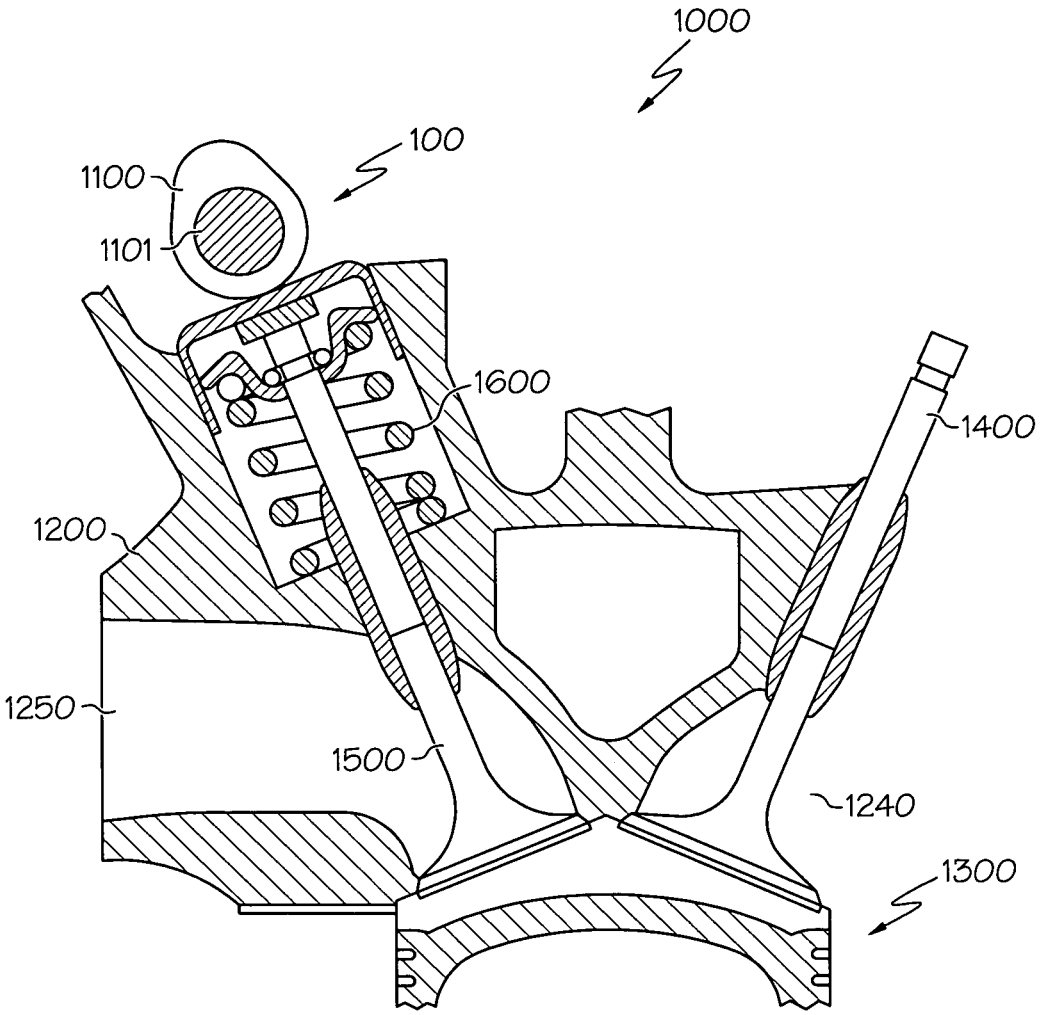
FIG. 7 shows a partial cutaway view of an automotive engine with a camshaft employing one or more lobes made by the stackable tooling modified DMC process of the present invention.

Referring next to FIGS. 3 through 7, a camshaft 100 (FIG. 6) includes numerous lobes 110A through 110P disposed thereon in a radial angle orientation relative to one another that is dictated by the required opening and closing sequence of valves 1400, 1500 in the engine 1000 of FIG. 7. The camshaft includes journal bearings 115 at the ends of the shaft 100, as well as intermittently along the shaft length for flexural support and overall dynamic stability. The camshaft lobes may be grouped into lobe packs 210 (also known as a two-lobe pack as shown in FIGS. 3) and 310 (also known as a three-lobe pack as shown in FIGS. 4A and 4B). Referring with particularity to FIG. 3, the two-lobe pack 210 contains two camshaft lobes 210A and 210B with differing lobe radial orientations relative to one another, separated axially by part 211 of the camshaft 100. A bore 215 extends axially through the two-lobe pack 210 to allow mounting on the correspondingly-sized camshaft 100 of FIG. 6.

Two-lobe pack 210 of FIG. 3 can be formed by the operation of the two-layer stackable tooling (also called a tooling die) 400 that includes an axisymmetric sleeve 420 surrounding a reusable insert die set 440 made up of an upper die 441 with inserts 441A, 441B, 441C and 441D (of which only 441A and 441B are shown) and lower die 442 with inserts 442A, 442B, 442C and 442D (of which only 442A and 442B are shown). As with the three-lobe pack configuration (which is discussed in more detail below and shown in FIG. 4B), the inserts 441A and 442B define generally axisymmetric-shaped outer surfaces 4412, 4422, while their non-axisymmetric inner surfaces 4411, 4421 mimic the desired outer shape of the three-lobe pack 210 being formed. Coils (not shown) similar to those of the prior art devices depicted in FIGS. 1A through 1C and 2 can be wound around sleeve 420 so that sleeve 420 is placed between the coil and the insert die set 440. An air gap may be situated between the coil and sleeve 420. As with conventional DMC, the present DMC-based process exploits the electric current flowing through coil in order to impart a magnetically-compressive force onto the sleeve 420, die set 440 and the precursor materials within that need to be compacted. Also as with a conventional DMC process, such compaction results in the formation of a "green" or un-sintered lobe pack that may undergo conventional sintering, machining and related finishing steps (none of which are shown).

The use of non-axisymmetric shapes on the inner surface 4411 and 4421 of the respective upper and lower dies 441 and 442 results in a modification to the DMC process so that the axisymmetric compaction of the traditional DMC process can be used to produce lobe pack 210. Specifically, the axisymmetrically-applied compressive load imparted to the tooling 400 from the current flowing through the coils (not shown) is transferred through the die set 440 to the non-axisymmetric shape defined by the inner surfaces 4411 and 4421 of the numerous inserts 441A, 441B, 441C and 441D (for upper die 441) and 442A, 442B, 442C and 442D (for lower die 441). Thus, by the present construction, the upper and lower dies 441 and 442 are made from a split (i.e., multi-piece) construction, and can be segmented in various ways, depending on the needs of the lobe pack being formed.

Figure 4A:
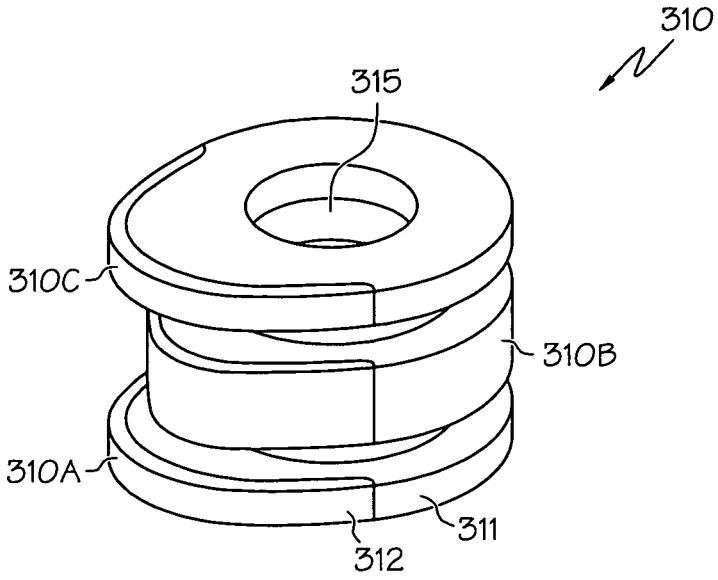
FIG. 4A shows a three-lobe pack as part of a camshaft made by the stackable tooling of the modified DMC process according to an aspect of the present invention.
Figure 4B:
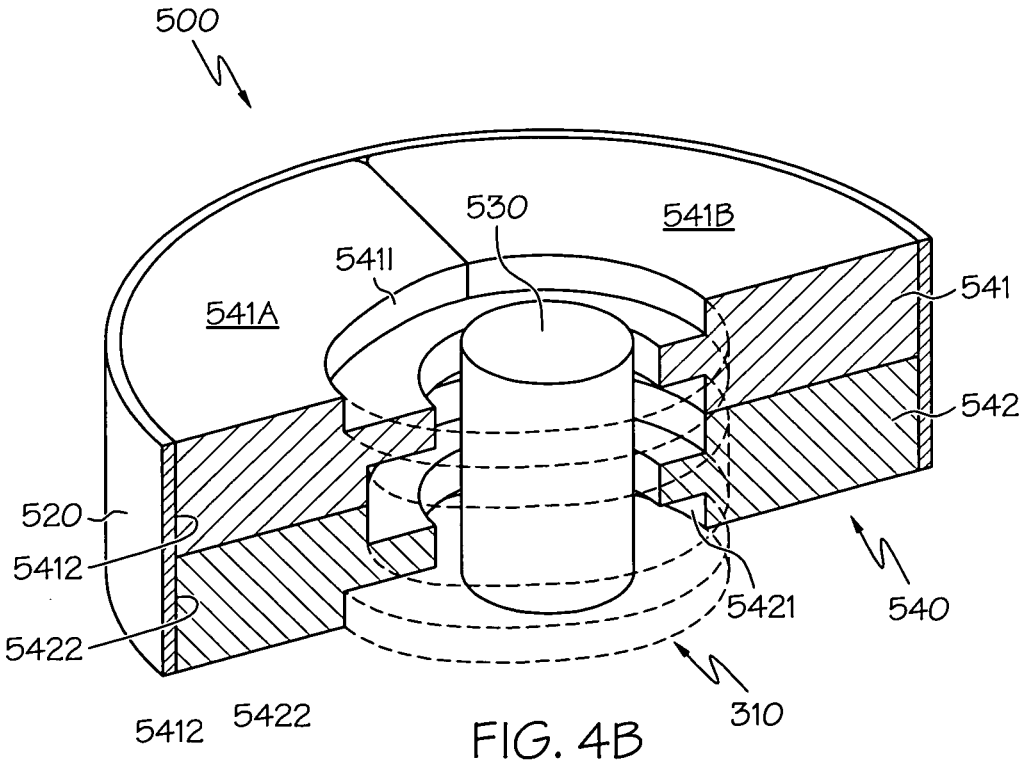
FIG. 4B shows the stackable tooling used to make the camshaft lobe pack of FIG. 4A.

The three-lobe cam pack 310 of FIGS. 4A and 4B is shown with lobes 310A, 310B and 310C, of which middle lobe 310B is of differing radial orientation, height and axial thickness. As with bore 215 of the two-lobe pack, a centrally-oriented bore 315 extends axially through the three-lobe pack 310. Referring with particularity to FIG. 4B, a cutaway view of stackable tooling 500 showing an axisymmetric sleeve 520 with a core rod (also referred to as a mandrel) 530 and reusable insert die set 540 made up of an upper die 541 and lower die 542 is disclosed. Each die 541, 542 within die set 540 includes various segmented inserts (for example, inserts 541A, 541B, 541C and 541D of upper die 541, of which only two inserts 541A and 541B are shown) defines a generally axisymmetric-shaped outer surfaces 5412, 5422, while its inner surfaces 5411, 5421 mimic the desired outer shape of the three-lobe pack 310 being formed. As with the tooling 400 shown in FIG. 3, the dies 541 and 542 can be made of split (i.e., multi-piece) construction as shown in the present cutaway, depending on the needs of the lobe pack being formed. Furthermore, the use of coils and related compaction equipment (not shown) is generally similar to that discussed above in conjunction with the two-lobe pack 210.

Referring again to FIG. 4A, each lobe of the three-lobe pack 310 has at least two distinct portions 311 and 312, while it will be appreciated that the two-lobe pack of FIG. 3 may be configured to possess similar attributes. The first portion 311 forms a base circle portion of any or all of the lobes 310A, 310B and 310C and is preferably made from a material such as an alloy steel powder possessive of mechanical properties suitable for camshaft lobe applications. In addition to occupying the substantial entirety of the axisymmetric portion of the lobes 310A through 310C, the first portion 311 can form the underlying (i.e., interior) surface of the non-axisymmetric part, and a first material can be used to define or otherwise occupy this first portion 311. By contrast, a second material can be used for the second portion 312 where additional structural (including tribological) properties may be desired. Unlike the first portion 311, the second portion 312 is preferably limited to parts of the lobes 310A through 310C that require the enhanced properties associated with the second material. As with the first material, the second material may be a metal powder specifically formulated to meet the specific needs for an application where the lobe surface would experience at least one of rolling loads, sliding loads or a combination thereof. In one example, the powder may be made from a ferrous alloy with chemical composition formulated in a way so as to improve wear resistance, friction reduction or the like of the second material. Two different powders may be used with differential fill rates and having different nozzle diameter and shapes, including but not limited to round, oval or slotted shapes. In such case, the lobe pack 310 may be made of two different powders, where lobes 310A and 310C may be made from one composition, while lobe 310B may be made from a different composition. In another example, the second portion 312 may be made from a substantially rigid insert different than that used for the majority of the matrix material of first portion 311. Because the second material is tailored to meet particular performance needs, and is typically at least one of more expensive, heavier or more difficult to fabricate with, it should be used sparingly. As such, it may be advantageous to only have it occupy as much surface area of each lobe 310A, 310B or 310C as necessary. By having this structurally-enhanced second material occupy the outer surface the second portion 312 of the lobes of the three-lobe pack 310, it can, with subsequent compaction with the first portion 311 by DMC, form lobe 310 into a substantially unitary structure with composite properties: a low-cost, lightweight, readily manufacturable first portion 311 and a durable, tribologically-enhanced second portion 312. Of course, the modified DMC process of the present invention works equally well in situations where a single material rather than a composite of two different materials is being used. Details regarding the use of first and second materials for the various portions of the lobes 210 and 310 can be found in U.S. patent application Ser. No. 12/247,287, filed Oct. 8, 2008 which is assigned to the Assignee of the present invention and hereby incorporated by reference.

Referring with particularity to FIG. 5, the ability to stack numerous tooling 500 members together to form part or all of a camshaft is shown, with a three stack tooling 500A, 500B and 500C surrounding two lobes 1310A and 1310C with a journal 1310B in the middle. Individual tooling members 500A, 500B and 500C are shown stacked and axially aligned along the longitudinal dimension of a camshaft being formed, of which a two-lobe pack with a journal in the middle is a segment. The two lobes 1310A and 1310C on the opposite sides of the journal 1310B may have different radial orientations. The stacked tooling is contained inside a cylindrical sleeve as previously discussed. The stacks 500A, 500B and 500C are assembled in the desired orientation followed by powder fill then DMC.

Referring with particularity to FIGS. 6 and 7, the camshaft 100 with a plurality of lobes 1100 and incorporation into an automotive engine 1000 is shown. As will be understood from the above discussion, any of the lobes 1100 that make up camshaft 100 may be formed from either a single material shown in FIG. 3 or the dual material (i.e., composite) configuration depicted in FIG. 4A. A central bore 1001 can be used to connect the numerous lobes 1100 together through a common shaft to result in the camshaft 100. Referring with particularity to FIG. 7, portions of the top of the automotive engine 1000 incorporating camshaft 100 made with lobes 1100 is shown for a notional direct-acting tappet design, where a piston 1300 reciprocates within a cylinder in the engine block (not shown). A cylinder head 1200 includes intake ports 1240 and exhaust ports 1250 with corresponding intake and exhaust valves 1400, 1500 to convey the incoming air and spent combustion byproducts, respectively that are produced by a combustion process taking place between the piston 1300 and a spark plug (not shown) in the cylinder. Camshaft 100 is driven by an external source such that upon camshaft 100 rotation about its longitudinal axis, the eccentric portion of the lobe 1100 selectively overcomes a bias in valve spring 1600 to force exhaust valve 1500 at the appropriate time. It will be appreciated that similar structure is included for the intake valve 1400, but is removed from the present drawing for clarity. The lobe 1100 of the present invention includes selective reinforcement in the eccentric portion as discussed above to promote enhanced durability and performance. It will be appreciated by those skilled in the art that the valve train architecture shown associated with engine 1000, which includes a direct-acting tappet, is merely representative, and that camshaft lobes manufactured using the process and tooling as described herein are equally applicable to other valve train architectures (not shown).

Figure 8:
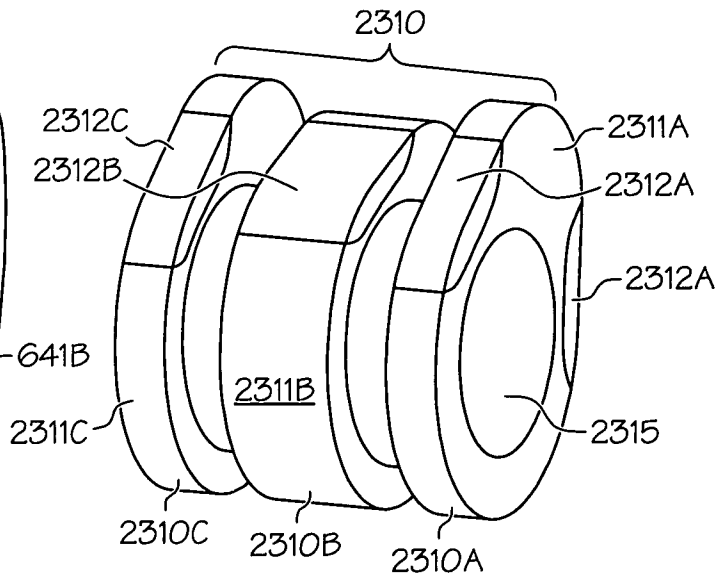
FIG. 8 shows a three-lobe pack with aligned orientation and hybrid material choice that is manufactured with the stackable tooling modified DMC process of the present invention.

Referring with particularity to FIG. 8, a variation on the three-lobe cam pack 310 of FIG. 4A is shown as three-lobe cam pack 2310. Unlike the version of FIG. 4A (where only the bottom and top lobes 310A and 310C are radially aligned), the lobes 2310A, 2310B and 2310C of the version depicted in FIG. 8 all have their apexes pointed along a common radial axis. This reflects the need in a valve design to have different valve lift as it pertains to a specific application. FIG. 8 additionally shows that the middle lobe 2310B has less valve lift than its surrounding lobes 2310A and 2310C, while another configuration (not shown) may have the middle lobe 2310B with a higher lift compared to the two outer lobe sections 2310A and 2310C. As stated above, depending upon application, the middle lobe section 2310B with portion 2312B may have same or different chemical composition. A centrally-oriented bore 2315 extends axially through the three-lobe pack 2310. As with the previously-discussed lobe packs, a first portion 2311 (shown for each of the lobes as 2311A, 2311B and 2311C) and corresponding material can form a majority of the non-axisymmetric part, while a second material can be used for the second portion 2312 (shown for each of the lobes as 2312A, 2312B and 2312C) where additional structural mechanical properties may be desired. As with the previously-discussed lobes, the second portion preferably occupies a smaller part of the lobes 2310A through 2310C than the first portion. As with the first material, the second material may be a metal powder specifically formulated to meet the specific needs for an application where the lobe surface would experience at least one of rolling loads, sliding loads or a combination thereof. In another form, it can be a rigid insert that can, through the DMC process, be bonded or otherwise affixed to the compactable powder material of the first portion.

Figure 9:
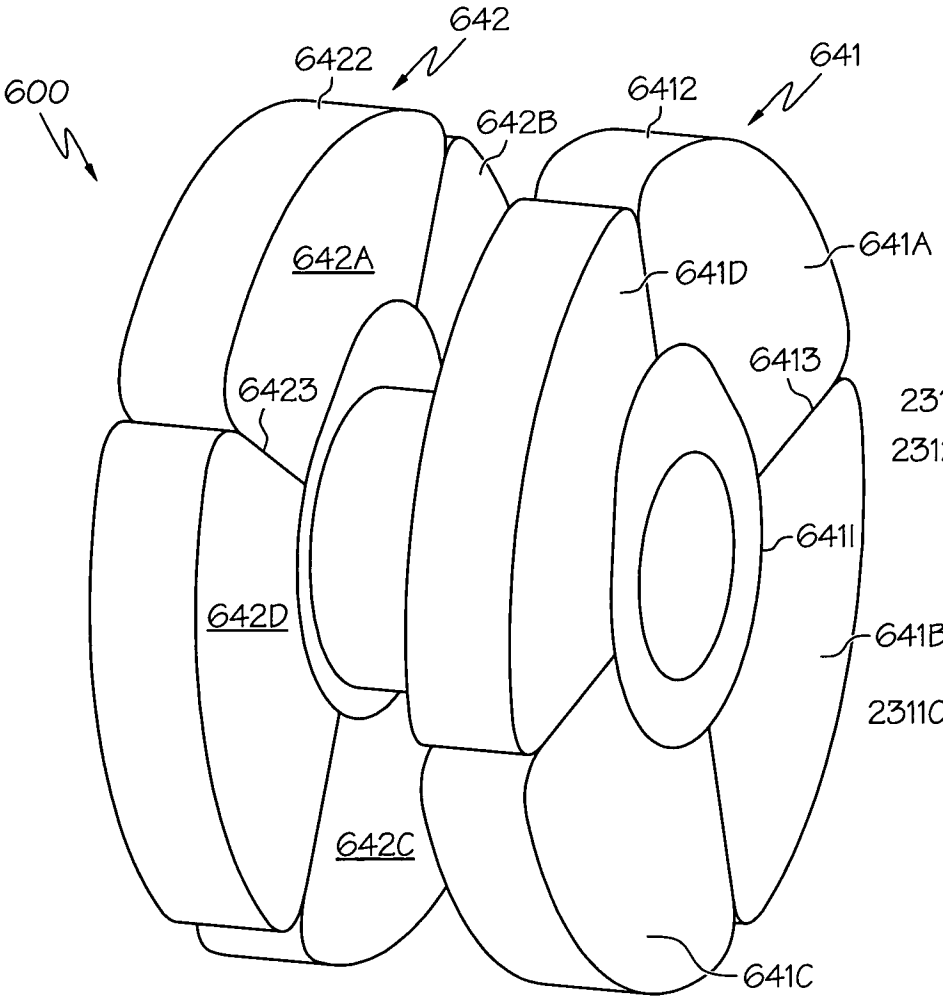
FIG. 9 shows reusable segmented inserts surrounding a two-lobe pack with offset orientation that is manufactured with the stackable tooling modified DMC process of the present invention.

Referring next to FIG. 9, a tool 600 (with the sleeve removed for clarity) using dies 641 and 642 with respective segmented inserts 641A, 641B, 641C and 641D (for die 641) and 642A, 642B, 642C and 642D (for die 642) of substantially equal-size is shown for a two-lobe pack. For additional clarity, round inserts that correspond to the axial space between the dies 641 and 642 are not shown. The aggregate outer surfaces 6412 and 6422 of the two assembled dies 641 and 642 define (with the exception of the areas immediately adjacent the split lines 6413 and 6423) a generally axisymmetric profile. As stated above in conjunction with FIG. 3, configuring the inserts into segments with corresponding split lines 6413 and 6423 allows the forming of more complex shapes.

While certain representative embodiments and details have been shown for purposes of illustrating the invention, it will be apparent to those skilled in the art that various changes may be made without departing from the scope of the invention, which is defined in the appended claims.

What is claimed is:

1. A method of fabricating at least one lobe pack for a camshaft using dynamic magnetic compaction, said method comprising:

arranging a plurality of tooling dies to cooperate with one another along their respective substantially axial dimensions, each of said tooling dies comprising an exterior and an interior the latter of which defines a shape that corresponds to an exterior shape of at least a plurality of lobes within said lobe pack;

placing a powder material within said interior of each of said tooling dies;

placing an electrically conductive coil about said plurality of tooling dies; and passing electric current through said coil such that a magnetic pressure pulse is applied to each of said plurality of tooling dies to achieve dynamic magnetic compaction of said powder material contained therein.

2. The method of claim 1, wherein said powder material comprises a metal powder.

3. The method of claim 2, wherein said powder material comprises a first powder material and a second powder material that has different wear properties relative to said first powder material, said second powder material placed in a location in a respective one of said plurality of tooling dies such that upon said dynamic magnetic compaction, said first and second powder materials become affixed to one another to form a substantially unitary lobe structure and said second powder material occupies a portion thereof that is exposed to at least one of an increased sliding load and an increased rolling load relative to a portion of said lobe that is occupied by said first powder material.

4. The method of claim 1, wherein said plurality of tooling dies comprises at least a first die defining a first interior profile corresponding to a first lobe pack and a second die defining a second interior profile corresponding to a second lobe pack.

5. The method of claim 4, wherein at least one of said first lobe pack and said second lobe pack comprises a two-lobe pack.

6. The method of claim 5, wherein at least one of said first lobe pack and said second lobe pack comprises a three-lobe pack.

7. The method of claim 4, wherein one of said first lobe pack and said second lobe pack comprises a three-lobe pack, and another of said first lobe pack and said second lobe pack comprises a three-lobe pack.

8. The method of claim 1, wherein said exterior shape of at least a plurality of lobes within said at least one lobe pack comprises a plurality of lobes axially spaced from one another and a journal disposed axially between said plurality of lobes.

9. The method of claim 1, wherein said exterior and said interior of at least one of said plurality of tooling dies are sized to form no more than one lobe of said at least one lobe pack.

10. The method of claim 1, wherein said exterior and said interior of at least one of said plurality of tooling dies are sized to form a plurality of lobes of said at least one lobe pack.

11. The method of claim 10, wherein said plurality of lobes of said at least one lobe pack are radially aligned with one another.

12. The method of claim 1, wherein said arranging a plurality of tooling dies comprises nestably stacking said plurality of tooling dies such that together they define a unitary tool defining multiple lobes of at least one lobe pack therein.

13. A method of fabricating an automotive camshaft using dynamic magnetic compaction, said method comprising:

providing a plurality of tooling dies each with a substantially axisymmetric sleeve disposed about at least one insert each of which defines a substantially axisymmetric exterior surface engagable with said substantially axisymmetric sleeve and an interior surface configured to receive a compactable powder material therein;

placing said compactable powder material within said interior surface;

placing an electrically conductive coil about said substantially axisymmetric sleeves of said plurality of tooling dies;

compacting said material contained in said aggregate interior surface through a magnetic field set up by passage of an electric current through said coil such that a lobe pack is formed within at least one of said tooling dies; and assembling said formed lobe packs into said camshaft.

14. The method of claim 13, wherein said interior surface defines axially aligned cam lobes spaced apart from one another by substantially axisymmetric journals.

15. The method of claim 13, wherein said powder material comprises a first powder material and a second powder material that has higher wear properties relative to said first powder material, said second powder material placed in a location in a respective one of said plurality of tooling dies such that upon said dynamic magnetic compaction, said first and second powder materials become affixed to one another to form a substantially unitary lobe structure and said second powder material occupies a portion thereof that is exposed to at least one of an increased sliding load and an increased rolling load relative to a portion of said lobe that is occupied by said first powder material.

* * * * *